US008967914B2

(12) United States Patent
Foo et al.

(10) Patent No.: US 8,967,914 B2
(45) Date of Patent: Mar. 3, 2015

(54) RISER PROTECTION STRUCTURES

(71) Applicants: Keppel Offshore & Marine Technology Centre Pte Ltd, Singapore (SG); ConocoPhillips Company, Houston, TX (US)

(72) Inventors: Kok Seng Foo, Singapore (SG); Michael John Perry, Singapore (SG); Quah Chin Kau Matthew, Singapore (SG); Cynthia Wang, Singapore (SG); Randall Scott Shafer, Houston, TX (US); Peter Noble, Spring, TX (US); Dominic P. Berta, Katy, TX (US)

(73) Assignees: Keppel Offshore & Marine Technology Centre, Singapore (SG); Pte Ltd/ConocoPhillips Company, Houston, TX (US)

( * ) Notice: Subject to any disclaimer, the term of this patent is extended or adjusted under 35 U.S.C. 154(b) by 0 days.

(21) Appl. No.: 13/767,884

(22) Filed: Feb. 15, 2013

(65) Prior Publication Data

US 2013/0230357 A1 Sep. 5, 2013

Related U.S. Application Data

(60) Provisional application No. 61/599,361, filed on Feb. 15, 2012.

(51) Int. Cl.
*E02B 17/08* (2006.01)
*E21B 17/01* (2006.01)
(Continued)

(52) U.S. Cl.
CPC ..... *E02D 5/226* (2013.01); *E02B 17/0021* (2013.01); *B63B 2211/06* (2013.01); *E02B 17/0017* (2013.01); *E21B 17/01* (2013.01)
USPC ..... 405/224.2; 405/196; 405/198

(58) Field of Classification Search
CPC . E02B 17/08; E02B 17/0017; E02B 17/0021; E21B 17/01; B63B 2211/06; E02D 5/226
USPC ..... 405/224, 224.2, 227, 228
See application file for complete search history.

(56) References Cited

U.S. PATENT DOCUMENTS 4,109,476 A * 8/1978 Gracia ..... 405/169
4,505,618 A 3/1985 Yashima
(Continued)

FOREIGN PATENT DOCUMENTS

GB 1492456 A 11/1977

OTHER PUBLICATIONS

International Search Report and Written Opinion of international application No. PCT/SG2013/000061 mailed Oct. 14, 2013 (10 pages).

*Primary Examiner* — Frederick L Lagman
(74) *Attorney, Agent, or Firm* — Pyprus Pte Ltd

(57) ABSTRACT

The present invention provides a riser protection structure being suitable to be employed in a Jackup rig. The riser protection structure comprises a plurality of piles, an upper module, wherein the upper module comprises a main protection tubing for receiving a riser, a plurality of sleeves to be installed over the plurality of piles, and a connecting network; wherein the plurality of sleeves are disposed around the main protection tubing; and wherein the main protection tubing and the plurality of sleeves are connected together by the connecting network, and a lower module, wherein the lower module comprises a plurality of tubular guides for guiding and later fixing the piles and a connecting structure, wherein the plurality of piles are securely disposed into the seabed for providing the requisite support for the upper and lower modules when they are assembled.

8 Claims, 5 Drawing Sheets

(51) Int. Cl.
*E02D 5/22* (2006.01)
*E02B 17/00* (2006.01)

(56) References Cited

U.S. PATENT DOCUMENTS 4,583,881 A * 4/1986 Steele ..... 405/198
4,668,127 A * 5/1987 Steele ..... 405/198
4,824,291 A * 4/1989 Coppens ..... 405/224
4,907,912 A * 3/1990 Smith ..... 405/208
5,051,036 A * 9/1991 Gomez De Rosas et al. 405/227
5,439,060 A * 8/1995 Huete et al. ..... 405/224.2
5,445,476 A * 8/1995 Sgouros et al. ..... 405/224
5,588,781 A * 12/1996 Smolinski et al. ..... 405/224
5,775,846 A * 7/1998 Blandford et al. ..... 405/227
5,899,639 A * 5/1999 Simmons ..... 405/227

* cited by examiner

RISER PROTECTION STRUCTURES

RELATED APPLICATION

This application claims the benefit under 35 U.S.C. 119(e) of U.S. Provisional Application Ser. No. 61/599,361, filed Feb. 15, 2012, which is herein incorporated by reference.

FIELD OF THE INVENTION

The present invention relates generally to jack-up rigs, and more particularly to a riser protection structure being suitable to be employed in a jack-up rig.

BACKGROUND OF THE INVENTION

A jack-up rig is an offshore oil and gas exploration or production drilling structure or a work-over platform being used in shallow water, typically in water with depths up to 500 feet. The jack-up rig usually comprises a floatable hull with a deck or working platform, and three or four legs, where the legs provide support for the floatable hull in elevated conditions. After the jack-up rig arrives on location, the legs are lowered until they touch the underneath seabed and rest on the soil at the seabed; then the hull may be jacked up using a jacking system to raise the working platform above the water, making the jack-up rig safe to be operated in open water situations where water movement is experienced.

During drilling operation, the oil or gas is drilled in an under seabed reservoir by drilling equipment on the working platform of a Jack-up rig; the drilling is usually through a riser. The existing options for providing protections to a riser include:

1. Drilling with the riser unprotected,
2. Providing coatings to the riser to protect against corrosion, fouling etc, but without protection from large ice or ship impacts.
3. Drilling through a minimal wellhead platform which supports the wellhead and conductor but is not designed to provide protection from large forces, for example ice or ship impacts.
4. Drilling through a substantial protection structure such as a conical piled monopod (CPM).
5. Drilling form a large combined drilling and production platform.

Options 3, 4 and 5 are all permanent structures and cannot be easily removed for reuse when the drilling activity is complete and not economical for exploration drilling where only one well is drilled at a location. As they are permanent they must also be designed for the worst possible design conditions as they cannot be removed if unusually large forces are expected.

SUMMARY OF THE INVENTION

Therefore, the present invention provides a riser protection structure that is suitable for providing protection to a riser, from forces due to, for example, ice or ship impacts. The riser protection structure can also provide protection to a subsea equipment such as a subsea blow out preventer or Auxiliary Safety isolation Device or Prepositioned Capping Device (PCD). In addition to protection from external forces, in the case of oil drilling activities, the riser protection structure can be used to provide detection and containment in the case of an oil leak.

One aspect of the present invention provides a riser protection structure being suitable to be employed in a Jackup rig. in one embodiment, the riser protection structure comprises a plurality of piles, an upper module, wherein the upper module comprises a main protection tubing for receiving a riser, a plurality of sleeves to be installed over the plurality of piles, and a connecting network; wherein the plurality of sleeves are disposed around the main protection tubing; and wherein the main protection tubing and the plurality of sleeves are connected together by the connecting network, and a lower module, wherein the lower module comprises a plurality of tubular guides for guiding and later fixing the piles and a connecting structure, wherein the plurality of piles are securely disposed into the seabed for providing the requisite support for the upper and lower modules when they are assembled.

In another embodiment of the riser protection structure, the plurality of piles have a cylindrical configuration.

In another embodiment of the riser protection structure, the plurality of piles are 3 or more.

In another embodiment of the riser protection structure, the connecting network is a truss structure or a plated structure.

In another embodiment, the riser protection structure, the top of the sleeves is partially or completely closed so as to allow the sleeves to sit on the top of the piles.

In another embodiment of the riser protection structure, each of the piles comprises a support structure fixed to the piles onto which the upper module is supported.

In another embodiment of the riser protection structure, the connecting structure of the lower module is a truss structure or a plated structure.

In another embodiment, the riser protection structure further comprises a bracing structure fixed to a Jackup deck in order to provide additional strength and stiffness to the riser protection structure.

The objectives and advantages of the invention will become apparent from the following detailed description of preferred embodiments thereof in connection with the accompanying drawings.

BRIEF DESCRIPTION OF THE DRAWINGS

Preferred embodiments according to the present invention will now be described with reference to the Figures, in which like reference numerals denote like elements.

DETAILED DESCRIPTION OF THE INVENTION

The present invention may be understood more readily by reference to the following detailed description of certain embodiments of the invention.

Throughout this application, where publications are referenced, the disclosures of these publications are hereby incorporated by reference, in their entireties, into this application in order to more fully describe the state of art to which this invention pertains.

The present invention provides riser protection structures that are employable example in a backup rig, designed for use when drilling from a Jackup drilling platform. Briefly, the riser protection structures comprise a plurality of piles, an upper module, and a lower module, wherein the plurality of piles are disposed around a riser of the Jackup rig, and the upper module is removably and slidably disposed onto the plurality of piles so as to provide the protection to the riser. The riser protection structures of the present invention possess many technical advantages. For example, the modular design allows the upper module to be removable so as to avoid large hazards if needed while leaving the lower module in place to protect subsea equipments such as Prepositioned Capping Device (PCD). In addition, the lower module can also provide detection and initial containment of a leak of gas or oil. Furthermore, the riser protection structures can be installed and removed using the available Jackup lifting equipment in the Jackup rig without incurring extra weight burden or equipment cost. Finally, as the Jackup rig is structurally stronger than the drilling riser, the riser protection structures of the present invention can extend the drilling season in Arctic Applications as the drilling riser can be protected from ice loads.

Figure 1:
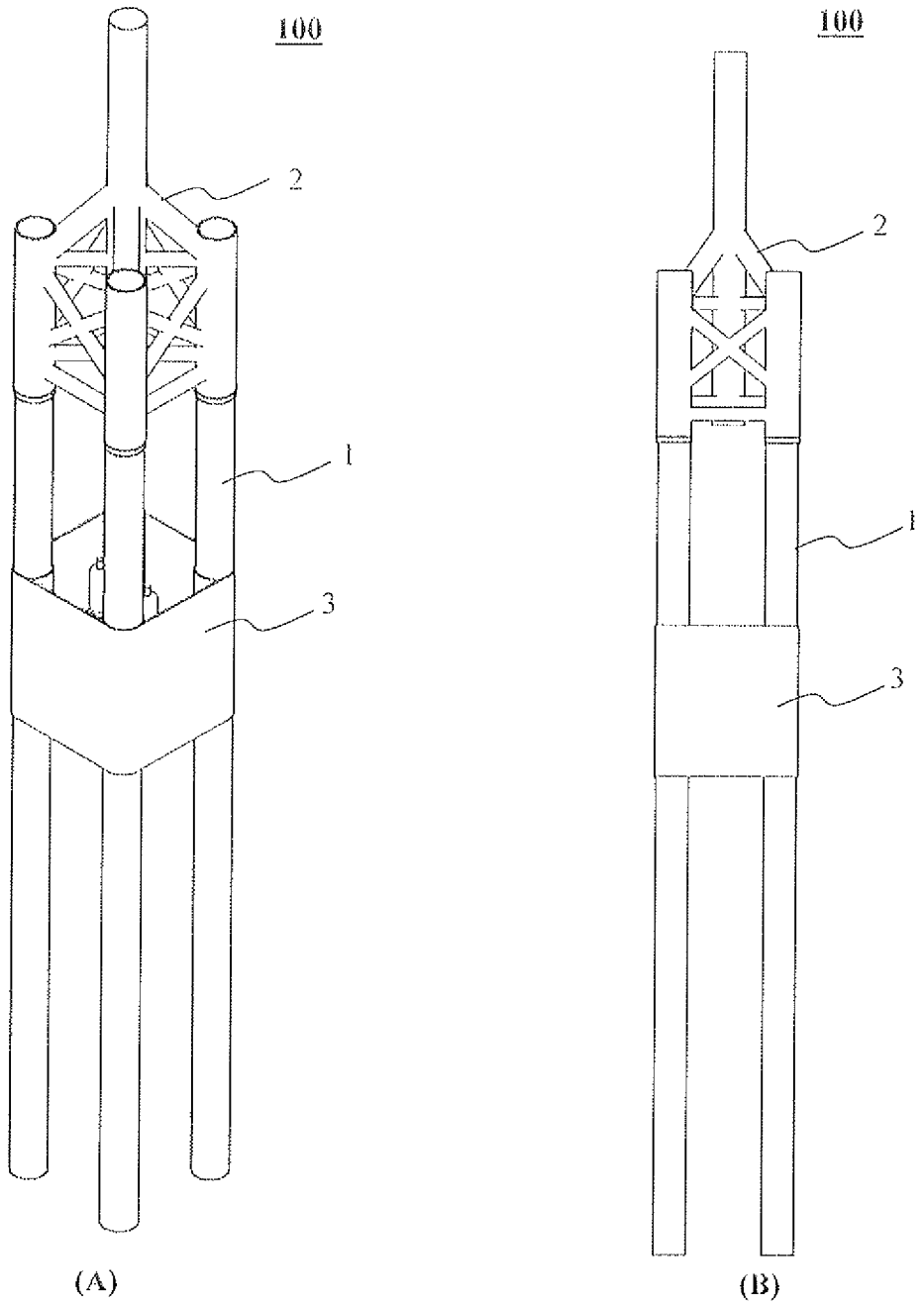
FIG. 1 shows the assembled riser protection structure in accordance with one embodiment of the present invention; (A) an isometric view; (B) a side view.
Figure 2:
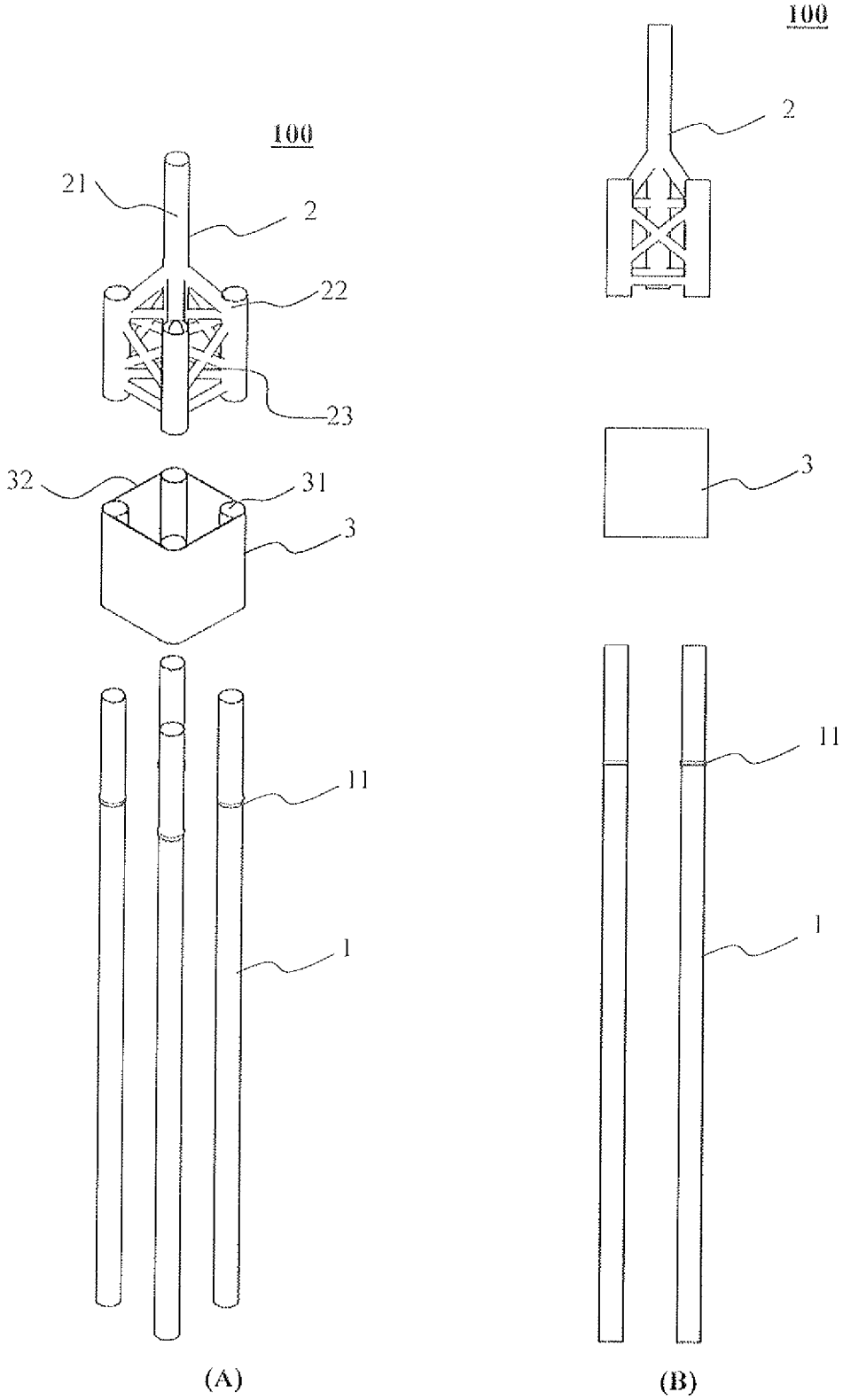
FIG. 2 shows the exploded view of the riser protection structure shown in FIG. 1; (A) an isometric view; (B) a side view.

Referring now to FIGS. 1 and 2, there is provided a riser protection structure in accordance with one embodiment of the present invention. The riser protection structure 100 comprises a plurality of piles 1, an upper module 2, and a lower module 3, where the plurality of piles 1 are securely disposed into the seabed for providing the requisite support for the upper and lower modules when they are assembled. In one embodiment, the plurality of piles 1 have a cylindrical configuration. It is to be noted that the plurality of piles can be in other configurations such as pentagon and hexagon. While 4 piles are shown in the present application, the number of piles can be 3 or more, depending upon the requirement of the practical application.

Figure 3:
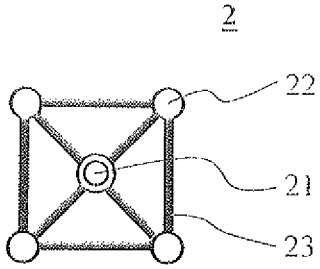
FIG. 3 shows a top view of the upper module shown in FIG. 2.

In connection with FIG. 3, the upper module 2 comprises a main protection tubing 21 for receiving the riser, a plurality of sleeves 22 to be installed over the plurality of piles 1, and a connecting network 23, where the plurality of sleeves 22 are disposed around the main protection tubing 21, and the main protection tubing 21 and the plurality of sleeves 22 are connected together by the connecting network 23. The connecting network 23 may comprise a truss structure or a plated structure. It is to be noted that the number of the sleeves 22 is identical to the number of the plurality of the piles 1, so that each sleeve is for one pile. The upper module 2 can be removably and slidably disposed onto the plurality of piles; the position of the upper module 2 on the piles can be determined by any suitable means. In one embodiment, the top of the sleeves 22 is partially or completely closed so as to allow the sleeves to sit on the top of the piles. In another embodiment, each of the piles comprises a support structure 11 fixed to the piles onto which the upper module can be supported.

Figure 4:
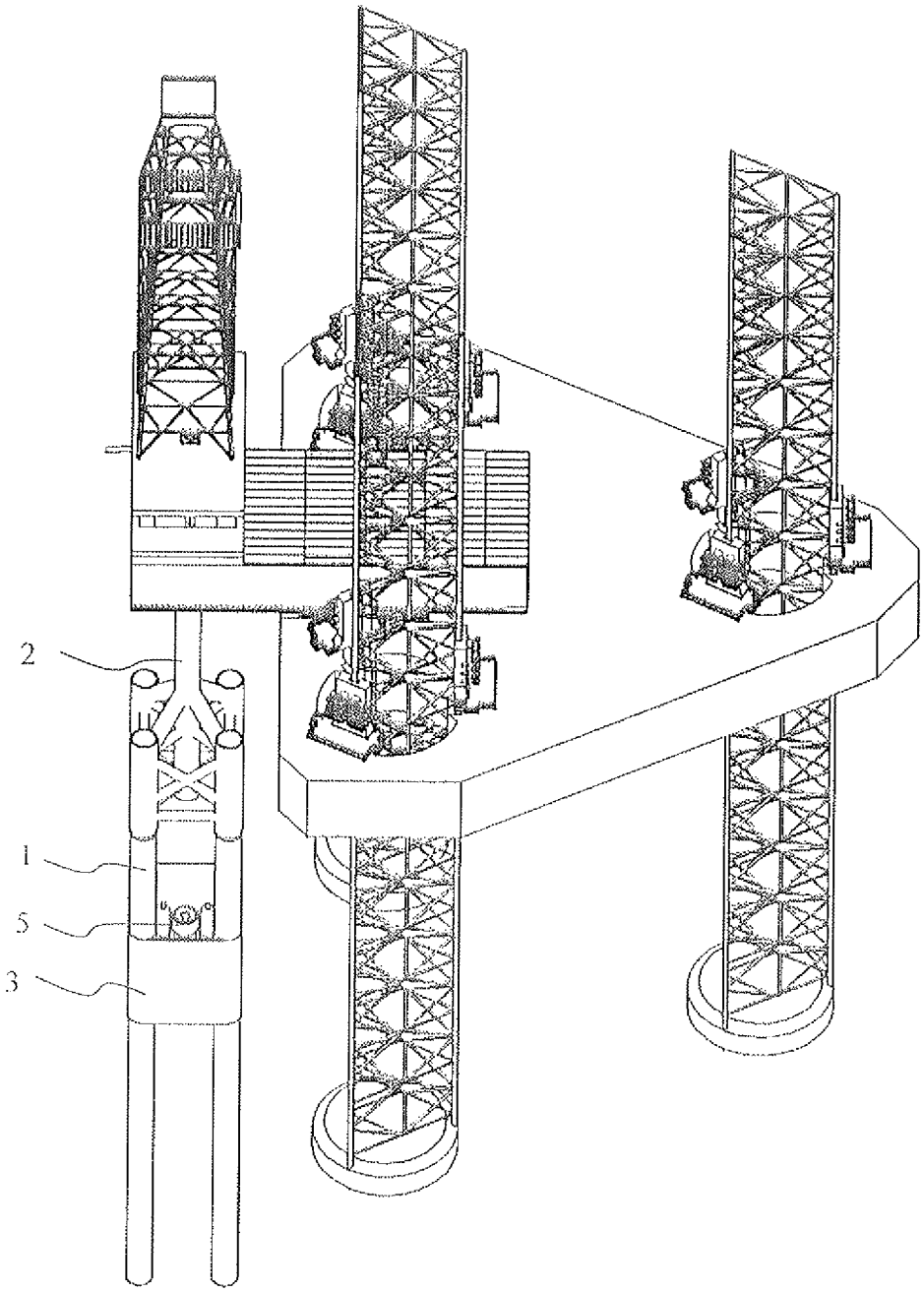
FIG. 4 shows an isometric view of the riser protection structure incorporated into a Jack-up rig in accordance with one embodiment of the present invention.

Referring still to FIGS. 1 and 2, the lower module 3 comprises a plurality of tubular guides 31 for guiding and later fixing the piles and a connecting structure 32. The connecting structure may be a truss structure or a plated structure, and may also serve as a protection for the subsea prepositioned capping device 5 (as shown in FIG. 4 of an assembled Jackup rig employing the riser protection structure of the present invention) and to detect and contain oil in the event of a leak. The lower module 3 may be designed mainly as a guide for the piles but may also be designed to be fixed to the piles in order to provide restraint and additional rigidity.

Figure 5:
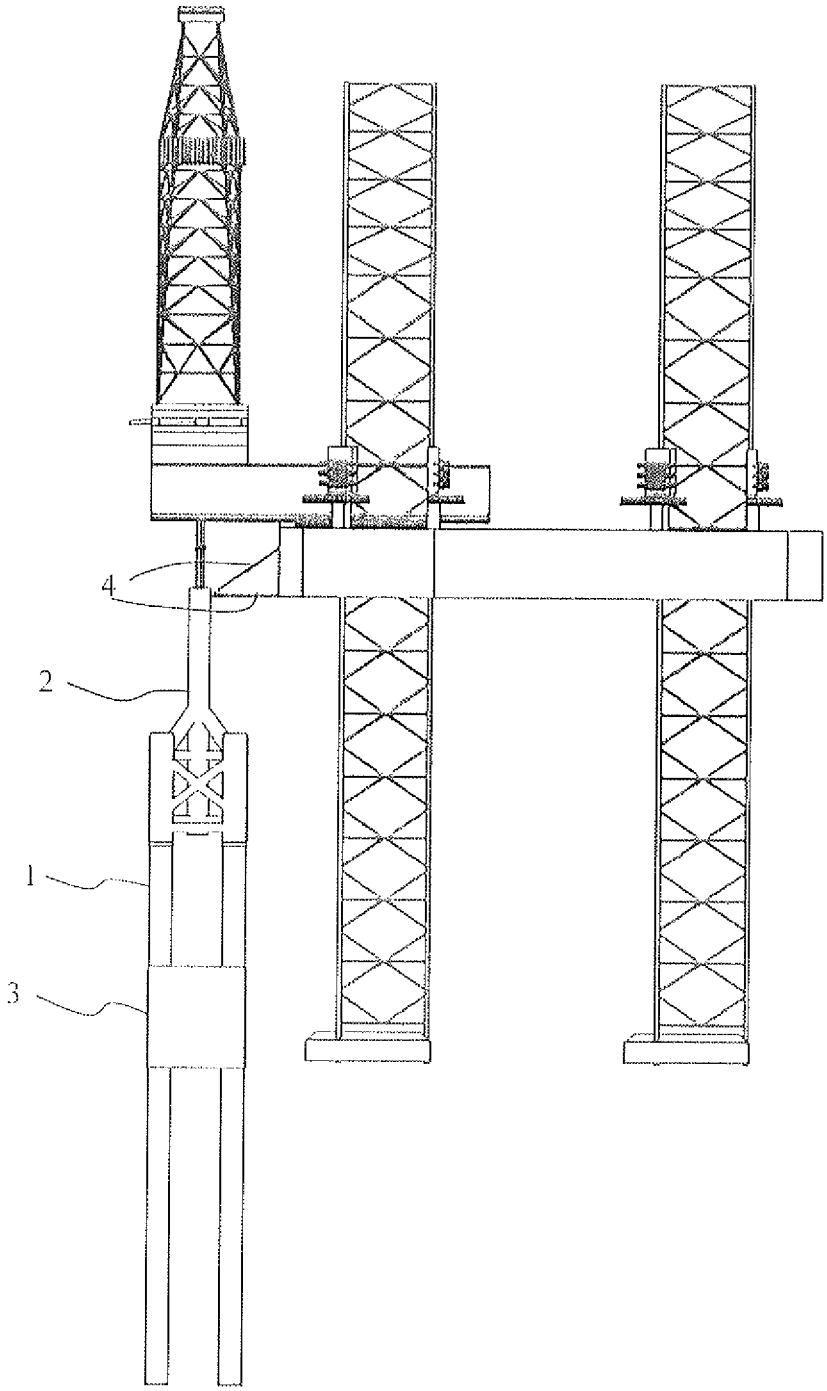
FIG. 5 shows a side view of the riser protection structure incorporated into a Jack-up rig in accordance with one embodiment of the present invention.

As shown in FIG. 5, the riser protection structure 100 further comprises a bracing structure 4 fixed to the Jackup deck in order 10 provide additional strength and stillness to the riser protection structure.

In the application of the riser protection structure of the present invention, the water depth is about 40 m however in other embodiments the water depth may be very shallow, 5 m, or range up to over about 100 m. The piles 1 may be about 3 m diameter, while the sleeves 22 and guides 31 should be larger in order to fit over the piles, the main protection tubing 21 may also be about 3 m. The connection network 23 is shown here as a truss structure with members in the range of 0.5 m to 2.5 m in diameter. In other embodiments, alternative arrangements and sizes of members are possible, or the connecting structure may be formed of a plated structure.

The riser protection structure protects a riser using a thick walled main protection tubing which extends from a distance substantially below the water level to a height above water level which exceeds the potential impact height. The main protection tubing protects the riser by deflecting and/or crushing incoming objects such as ships and ice. The loads imparted on the tubing are then transferred to the pile sleeves, into the piles and finally to the seabed. The spread pile arrangement and stiff connecting structures provide adequate stiffness to prevent excessive deformations which could damage the riser within. For cases where very high loads are expected, the tubing may be further supported by connecting a bracing structure 4 to the Jackup hull, increasing the strength and stiffness of the system.

The installation of the riser protection structure of the present invention follows the following proposed sequence, however it would also be possible to install the structure in other ways. The lower module 3 is first lowered to the seabed. Mud mats or similar features may be attached to the base of the lower module to provide adequate seabed stability during this phase. The plurality of piles 1 are then installed through the guides 31 provided by the lower structure. In some cases, where extra rigidity is required, the lower structure can be fixed to the piles using for example mechanical clamping, grouting or swagging. The piles may include support structures 11 onto which the upper module 2 will be installed. These support structures 11 may be adjustable, for example by a clamping device or by means of additional shimming plates, such that the level can be adjusted prior to installation of the upper structure. Alternatively the top of the sleeves of the upper module may be closed or partially closed in order to sit on the top of the piles. The upper module 2 is then installed by lifting over the piles and resting on the top of the piles or on the supporting structures provided on the piles. Damping devices such as rubber pads may be provided at the interface to improve the seating. Internal centralizing devices may also be used to align the sleeves 22 and piles. In many case the structure will be able to provide suitable protection without further installation steps. In some cases however an additional clamping device may be used to secure the sleeves to the piles. In addition, if forces are large, an additional brace structure 4 may be connected to the jackup hull in order to provide additional restraint.

The removal of the riser protection structure will be necessary for example;

If the drilling operation is complete

If exceptionally large objects are expected to impact the structure. For example, this may be from an incoming ice feature that exceeds the designed capacity of the structure.

In cases such as above, the drilling operations would stop, the well properly contained and the riser would be removed from the well. The upper part of the structure can then simply be lifted off the piles and removed from the site. The top of the piles and the lower structure are designed to be far enough below the sea surface to avoid contact with major floating hazards and so can be left in place and reused when the hazard has passed.

If the drilling operation is complete, as in the first case above, and the site is to be abandoned, the lower structure can be removed and the piles can also be cut off below the seabed for removal.

While the present invention has been described with reference to particular embodiments, it will be understood that the embodiments are illustrative and that the invention scope is not so limited. Alternative embodiments of the present invention will become apparent to those having ordinary skill in the art to which the present invention pertains. Such alternate embodiments are considered to be encompassed within the scope of the present invention. Accordingly, the scope of the present invention is defined by the appended claims and is supported by the foregoing description.

What is claimed is:

1. A jackup rig, comprising:

a plurality of legs;

a jackup deck being supported by the plurality of legs; and a riser protection structure comprising:

a plurality of piles;

an upper module removably and slidably disposed onto the plurality of the plurality of piles, wherein the upper module comprises a main protection tubing for receiving a riser, a plurality of sleeves to be installed over the plurality of piles, and a connecting network; wherein the plurality of sleeves are disposed around the main protection tubing; wherein the main protection tubing and the plurality of sleeves are connected together by the connecting network, and wherein the upper module provides no support to the jackup deck and can be removed from the plurality of piles when the jackup rig is in its assembled state; and a lower module, wherein the lower module comprises a plurality of tubular guides for guiding and later fixing the piles and a connecting structure connecting the plurality of tubular guides together;

where the plurality of piles are securely disposed into the seabed for providing the requisite support for the upper and lower modules when they are assembled.

2. The jackup rig of claim 1, wherein the plurality of piles have a cylindrical configuration.

3. The jackup rig of claim 1, wherein the plurality of piles are 3 or more.

4. The jackup rig of claim 1, wherein the connecting network of the upper module is a truss structure or a plated structure.

5. The jackup rig of claim 1, wherein the top of the sleeves is partially or completely closed so as to allow the sleeves to sit on the top of the piles.

6. The jackup rig of claim 1, wherein each of the piles comprises a support structure fixed to the piles onto which the upper module is supported.

7. The jackup rig of claim 1, wherein the connecting structure of the lower module is a truss structure or a plated structure.

8. The jackup rig of claim 1, further comprising a bracing structure fixed to the jackup deck in order to provide additional strength and stiffness to the riser protection structure.

* * * * *